United States Patent [19]

Chvatlinsky

[11] 4,161,373

[45] Jul. 17, 1979

[54] TYPING DEVICE INCLUDING A TYPE DISC

[75] Inventor: Kurt Chvatlinsky, Wilhelmshaven, Fed. Rep. of Germany

[73] Assignee: Olympia Werke AG, Wilhelmshaven, Fed. Rep. of Germany

[21] Appl. No.: 825,541

[22] Filed: Aug. 16, 1977

[30] Foreign Application Priority Data

Sep. 4, 1976 [DE] Fed. Rep. of Germany ..... 2639872

[51] Int. Cl.[2] ..... B41J 1/04

[52] U.S. Cl. ..... 400/175; 400/144.2

[58] Field of Search ..... 308/DIG. 8; 101/109, 101/110, 111; 400/144.2, 144.3, 175, 174, 149, 150, 171; 192/67 R

[56] References Cited

U.S. PATENT DOCUMENTS

| | | | |
|---|---|---|---|
| 752,792 | 2/1904 | Moya | 400/144.2 |
| 3,055,769 | 9/1962 | Herron | 308/DIG. 8 |
| 3,741,855 | 6/1973 | Harrison et al. | 308/DIG. 8 |
| 3,805,698 | 4/1974 | Bowers, Jr. et al. | 101/111 |
| 3,884,339 | 5/1975 | Castoldi et al. | 400/144.3 |
| 3,986,593 | 10/1976 | Orlens et al. | 400/175 |
| 4,049,109 | 9/1977 | Plaza | 400/175 |
| 4,124,312 | 11/1978 | Johnson | 400/144.2 |
| 4,127,335 | 11/1978 | Bogert et al. | 400/144.2 |

FOREIGN PATENT DOCUMENTS

| | | | |
|---|---|---|---|
| 2614801 | 10/1977 | Fed. Rep. of Germany | 101/93.03 |

*Primary Examiner*—William Pieprz

*Attorney, Agent, or Firm*—Spencer & Kaye

[57] ABSTRACT

A typing device includes a frame; a drive shaft rotatably supported in the frame; a type disc arranged in the frame for being rotated by the drive shaft; a conically centering bearing assembly situated between one side of the type disc and a frame part; a coupling arrangement for torque-transmittingly and axially relatively displaceably connecting the type disc to the drive shaft; and a spring axially urging the type disc against the frame part for a conical centering of the type disc on the frame part by the bearing assembly.

13 Claims, 4 Drawing Figures

TYPING DEVICE INCLUDING A TYPE DISC

BACKGROUND OF THE INVENTION

This invention relates to a typing device including a type disc which carries characters attached to elastic bars and which is movable by a drive shaft. The drive shaft is further so arranged that when the type disc reaches a predetermined angular position for printing the desired character, the type disc may be retained in that angular position by the drive shaft. U.S. Pat. No. 3,983,985 discloses a typing device of the above kind in which the type disc is arranged releasably, by means of a hook element, at one terminus of the drive shaft. The type disc thus may be taken off the drive shaft and may be replaced by another type disc. Consequently, the ever-present bearing play of the drive shaft is transmitted to the type disc whose radial motions result in a smudgy print.

SUMMARY OF THE INVENTION

It is an object of the invention to provide an improved typing device which includes a type disc and in which the radial displacements of the drive shaft caused by the bearing play have no affect on the type disc.

This object and others to become apparent as the specification progresses, are accomplished by the invention, according to which, briefly stated, the type disc is supported, at one of its sides, by means of a conically centering bearing on a machine frame with the aid of a spring which biases the type disc in the axial direction. The type disc is coupled with the drive shaft solely in a torque-transmitting manner.

The invention as outlined above makes possible to obtain, with simple and economical means, a uniform and highly satisfactory print in a type disc-based typing device. Because of the separate support of the type disc, on the one hand, and the drive shaft, on the other hand, even small radial displacements of the drive shaft can no longer be transmitted to the type disc which is supported in a play-free manner.

DESCRIPTION OF THE PREFERRED EMBODIMENTS

Figure 1:
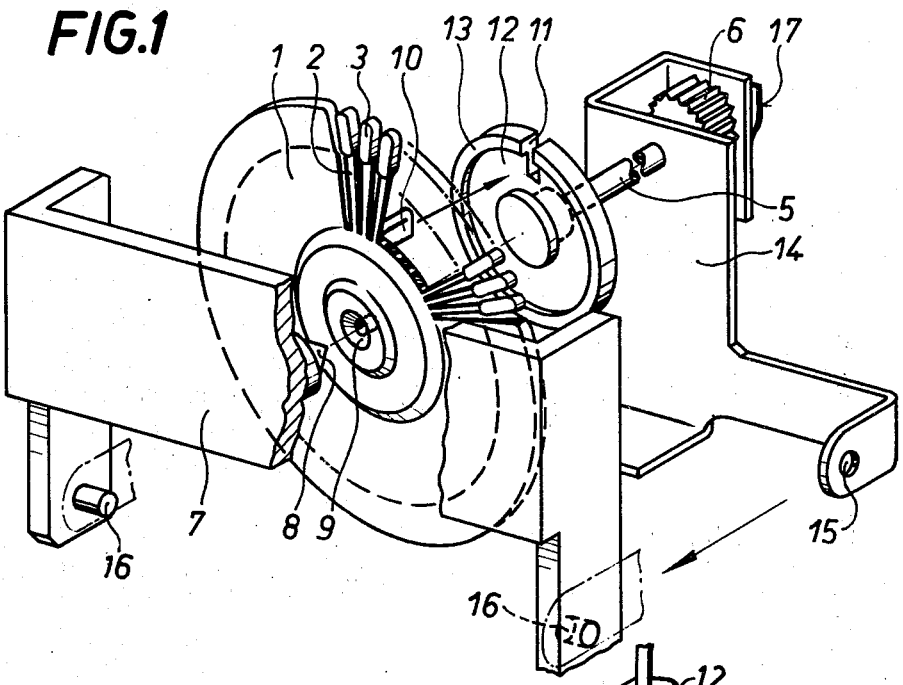
FIG. 1 is an exploded isometric view of components of a typing device incorporating a preferred embodiment of the invention.

Turning now to FIG. 1, the typing device illustrated therein includes a type disc 1 having a circular array of radial slots to define, therebetween, elastic bars 2. At the outer end of each bar 2 there is affixed a character 3. Adjacent the type disc 1, in the zone of the characters 3, there is arranged a platen 4 arranged to receive a print carrier (recording medium) to be provided with print. The type disc 1 is coupled torque-transmittingly with a drive shaft 5 in a manner to be described later. The drive shaft 5 is movable by means of a gear 6 and may be immobilized when the type disc 1 reaches the predetermined angular position. For causing a printing of the desired character, there is provided a hammer device (not shown) which delivers a blow on the respective bar 2 of the stopped type disc 1, whereby the character 3 affixed to that bar is pressed on the print carrier positioned on the platen 4.

In order to obtain a clean print, the type disc 1 should be supported in a play-free manner. For this purpose, in a frame part 7 there is arranged a fixed, conical centering pin 8 cooperating with a complemental conical seat 9 provided in the hub of the type disc 1. Thus the components 8 and 9 form a conically centering bearing assembly. The frame part 7 is either part of the machine frame if the typing machine is of the kind which has a platen advanced stepwise in the direction of typing or the frame part 7 is part of the carriage frame in case the carriage is moved with the type disc relative to a stationary platen in the direction of the typing.

Figure 2:
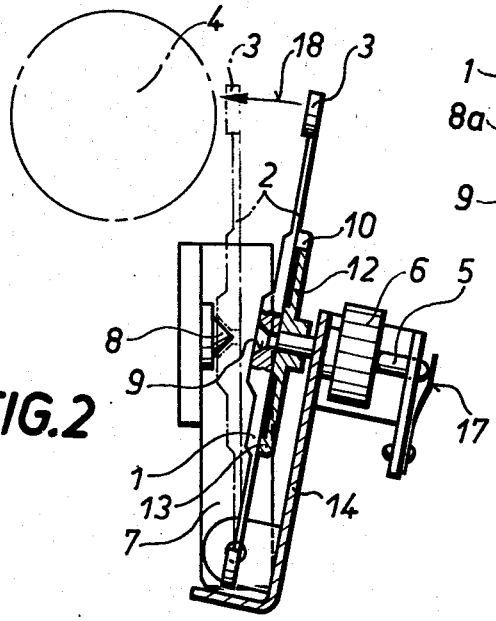
FIG. 2 is a sectional elevational view of the same embodiment illustrating the type disc in a "tilted-open" (inoperative) position of the device.

The type disc 1 is torque-transmittingly coupled with the drive shaft 5. For this purpose the type disc 1 has a rearwardly oriented eccentric actuating pin 10 which extends into a radial slot 11 provided in a pressing disc 12. The latter is provided with a circumferential, axially extending rim 13, the radially oriented edge face of which lies against the type disc 1. The pressing disc 12 is fixedly connected with the drive shaft 5 which is longitudinally displaceably supported in a bearing bracket 14. The latter, which also supports the driving mechanism as well as the ribbon (for example, in a cartridge) is, with bore holes 15, supported on respective pins 16 of the frame part 7 to be thus pivotal about an axis which is perpendicular to the drive shaft. The bearing bracket 14 may be immobilized in the operational (writing) position or in the inoperative ("tilted-open") position as illustrated in FIG. 2 in phantom lines and solid lines, respectively. To the bearing bracket 14 there is secured a leaf spring 17 which biases the drive shaft towards the machine frame part 7.

After the bearing bracket 14, together with the type disc 1, has been brought into its tilted-open position as illustrated in FIG. 2, the type disc 1 may be removed by pulling it out upwardly and may be replaced by another type disc 1, the actuating pin 10 of which is then inserted into the slot 11 of the pressing disc 12. For placing the typing device into the operative position, the type disc 1 is, from its position shown in solid lines in FIG. 2, pivoted counterclockwise in the direction of the arrow 18 into the phantom line position, so that the conical seat 9 of the type disc 1 is urged firmly against the conical centering pin 8 of the machine frame part 7. The type disc 1 is, by means of the stationary centering pin 8, and the conical seat 9 conically centered at one of its sides and is thus supported in the frame part 7 in a play-free manner. Consequently, radial displacements of the drive shaft 5 (held in the bearing bracket 14) caused by bearing play cannot be transmitted to the type disc 1. The leaf spring 17 continuously urges the type disc 1 against the stationary centering pin 8 with the intermediary of the axially displaceable drive shaft 5 and the rim 13 of the pressing disc 12, so that bearing tolerances of the type disc 1 have no effect. Further, the circumferential rim 13 of the pressing disc 12 maintains the type disc 1 flat in a plane which is perpendicular to the drive shaft 5 for preventing any wobbling motion of the type disc 1.

Thus, the spring-biased rimmed and radially slotted pressing disc 12 provides for a torque transmission to the type disc 1 and a plane centering thereof, an elimination of the effects of bearing tolerances as well as a rapid replacement of the type disc 1.

Figure 3:
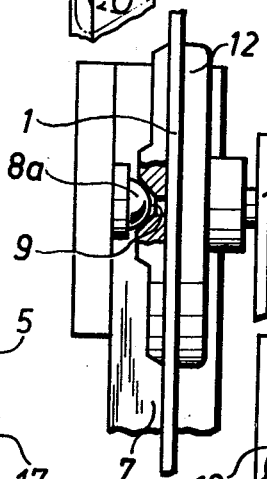
FIGS. 3 and 4 are fragmentary elevational views, partially in section, of the typing device showing two further embodiments of the invention in the operative position of the device.

In the embodiment illustrated in FIG. 3 the conical centering pin of the previously described emobodiment is replaced by a spherical centering pin 8*a* received in the conical seat 9 provided in the hub of the type disc 1.

Figure 4:
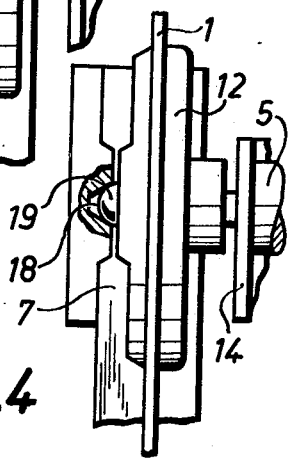

Turning now to FIG. 4, in the embodiment shown therein the seat-and-pin arrangement is reversed: the conical seat 18 is provided in the frame part 7, while a spherical centering pin 19 which is received in the seat 18 in the operative position of the writing device, is affixed to the hub of the type disc 1.

The conical or spherical centering pin may be made of a synthetic material (such as PTFE) or a self-lubricating sintered material (such as sintered bronze or sintered iron).

It is to be understood that the invention is not limited to a typing device of the above-specified structure. In all cases the separate support of the type disc and the drive shaft by means of a play-free, conically centered positioning of the type disc at one of its sides in the frame and the elimination of the effect of bearing tolerances by means of a spring, result in a type disc-based typing device of simple structure which ensures a very clean print and makes possible a rapid and simple exchange of the type disc.

It will be understood that the above description of the present invention is susceptible to various modifications, changes and adaptations, and the same are intended to be comprehended within the meaning and range of equivalents of the appended claims.

What is claimed is:

1. In a typing device including a frame; a drive shaft; support means for rotatably supporting the drive shaft in the frame; and a type disc arranged in the frame for being rotated by the drive shaft; the improvement comprising (a) a conically centering bearing assembly situated between one side of said type disc and a frame part; said centering bearing assembly being the sole means for the radial centering of said type disc with respect to said drive shaft;

(b) means for coupling said type disc to said drive shaft; said means for coupling being arranged for transmitting solely rotary motions of said shaft to said type disc to thereby prevent radial excursions of said drive shaft from being transmitted to said type disc; and (c) a spring means axially urging said type disc against said frame part for a conical centering of said type disc on said frame part by said bearing assembly.

2. A typing device as defined in claim 1, wherein said bearing assembly has a first bearing component affixed to said frame part and a second bearing component affixed to said type disc.

3. A typing device as defined in claim 2, wherein one of said bearing components is a bearing pin and the other of said bearing components is a conical bearing seat receiving said bearing pin.

4. A typing device as defined in claim 3, wherein said bearing pin has a conical terminus.

5. A typing device as defined in claim 3, wherein said bearing pin has a spherical terminus.

6. A typing device as defined in claim 3, wherein said bearing pin is said first bearing component and said conical bearing seat is said second bearing component.

7. A typing device as defined in claim 3, wherein said bearing pin is said second bearing component and said conical bearing seat is said first bearing component.

8. A typing device as defined in claim 3, wherein said bearing pin consists of a synthetic material.

9. A typing device as defined in claim 3, wherein said bearing pin consists of a self-lubricating sintered material.

10. A typing device as defined in claim 1, wherein said support means axially displaceably supports said drive shaft in said frame; said means for coupling including a pressing disc affixed to said drive shaft and torque-transmittingly coupled to said type disc; said spring means urging said pressing disc into contact with said type disc.

11. A typing device as defined in claim 10, wherein said pressing disc has a circumferential rim oriented towards said type disc; said rim having a radially extending edge face urged by said spring means into engagement with said type disc.

12. A typing device as defined in claim 10, wherein said pressing disc has a radial slot and said type disc has an actuating pin projecting into said slot; said actuating pin and said radial slot forming part of said means for coupling.

13. A typing device as defined in claim 1, further comprising means for pivotally securing said support means to said frame to provide for a swinging motion of said support means, together with said drive shaft, about an axis oriented perpendicularly to said drive shaft.

* * * * *